United States Patent [19]

Akonteh et al.

[11] 4,084,831

[45] Apr. 18, 1978

[54] SKATEBOARD WITH CONTROL UNIT

[76] Inventors: Ayola Ngwa Akonteh; Y. C. Richard Kwor, both c/o P.O. Box 6628, Stanford, Calif. 94305

[21] Appl. No.: 713,068

[22] Filed: Aug. 9, 1976

[51] Int. Cl.[2] ..... A63C 17/14

[52] U.S. Cl. ..... 280/11.2; 188/29; 280/87.04 A

[58] Field of Search ..... 280/87.04 A, 87.04 R, 280/11.2, 11.21; 188/29, 2 R

[56] References Cited

U.S. PATENT DOCUMENTS

| | | | |
|---|---|---|---|
| 1,517,352 | 12/1924 | Foote | 280/11.2 |
| 1,933,421 | 10/1933 | Elliotte | 280/87.04 A |
| 2,173,716 | 9/1939 | Gulleay | 280/11.2 |
| 3,028,171 | 4/1962 | Davis | 280/11.2 |
| 3,288,251 | 11/1966 | Sakwa | 280/87.04 A |
| 3,385,608 | 5/1968 | Waddell | 280/11.2 |
| 3,580,594 | 5/1971 | Ware | 280/11.2 |
| 3,945,655 | 3/1976 | Banks et al. | 280/87.04 A |
| 4,003,582 | 1/1977 | Maurer | 280/87.04 A |

*Primary Examiner*—David M. Mitchell

[57] ABSTRACT

A skateboard having front and rear wheel assemblies and a control unit coupled with one of the assemblies for applying braking forces to the wheels of said one assembly. The control unit includes a frame having a pair of spaced sides, and means pivotally mounting the frame for movement in a direction permitting the sides to move into braking relationship to the adjacent wheels. A stub shaft extends through the skateboard and is in a position to be depressed by the foot of the user when the frame is to be pivoted to cause the sides thereof to engage the wheels. Several embodiments of the control unit are disclosed.

13 Claims, 4 Drawing Figures

SKATEBOARD WITH CONTROL UNIT

This invention relates to improvements in skateboards and, more particularly, to a skateboard which can be controlled during movement by braking forces applied to one or more of its wheels.

BACKGROUND OF THE INVENTION

Certain types of conventional skateboards have front and rear wheel assemblies which can pivot about horizontal and vertical axes to permit greater control of the skateboard during forward movements and while making turns. Thus, by shifting his weight from side to side or fore and aft, the user of such a skateboard can achieve a certain measure of control in maneuvering the skateboard. However this control is minimal inasmuch as there is no way to decelerate the skateboard during such movements and while in such turns except by placing one foot on the ground. When this is done, a planned maneuver is impaired and cannot always be carried out successfully or as desired.

The primary object of this invention is to provide an improved skateboard having a control means thereon for controllingthe rotation of the wheels of one of the wheel and axle assemblies of the skateboard to thereby permit the application of control forces to such wheels during forward movement of skateboard or during turns, thereby enhancing the enjoyment of the use of the skateboard as well as to permit the skateboard to perform in a manner not capable of being accomplished with conventional skateboards.

Another object of this invention is to provide a skateboard of the type described wherein the control means comprises a frame pivotally mounted on the skateboard and moveable into engagement with the wheels thereof to apply braking forces thereto as the skateboard moves over a surface to thereby cause the wheels to decelerate to thereby permit the performance of intricate maneuvers or turns by virtue of the control afforded by the deceleration of the wheels.

Another object of this invention is to provide a control apparatus for a skateboard of the type described wherein the control apparatus can be mounted on conventional skateboards to provide added enjoyment in the use of the same, all of which can be accomplished without substantial structural modification of the skateboard itself.

Other objects of this invention will become apparent as the following specification progresses, reference being had to the accompanying drawings for an illustration of several embodiments of the invention.

In view of these limitations of conventional skateboards a need has arisen for an improved skateboard which can be controlled during use to a greater degree than is capable of being accomplished with a conventional skateboard.. More specifically, a need has arisen for a control unit to be provided for a conventional skateboard to permit it to be controlled in a more efficient manner than without such a control unit.

SUMMARY OF THE INVENTION

The present invention is directed to an improved skateboard and control unit to satisfy the foregoing needs. To this end, the skateboard has the control unit mounted thereon in a manner to permit the skateboard user to control the speed of rotation of the wheels of one of its wheel assemblies during movement of the skateboard over a surface to allow for more precise handling of the skateboard, such as during maneuvers and turns, thereby to provide additional operating skills and greater enjoyment for the user of the skateboard.

The control unit of the present invention comprises a frame pivotally mounted on the skateboard at a location adjacent to one of the wheel assemblies thereof so the the frame can move into engagement with one or both of the wheels of the wheel assembly to apply braking forces thereto so as to decelerate the wheels to a greater or lesser degree, depending upon the type of maneuver or turn which is desired to be made during the use of the control unit. In a preferred embodiment, the frame is adjacent to the rear wheel assembly of the skateboard and is provided with a pair of opposed sides having flat lower surfaces for engaging respective wheels of the assembly a shiftable actuator shaft accessible to the foot of the user standing on the upper surface of the skateboard is used to move the frame relative to the skateboard so that the sides of the frame can move into engagement with respective wheels. The connection between the actuator shaft and the frame is a ball and socket joint or resilient connection to permit the frame to rock or pivot relative to the actuator shaft during turns or other maneuvers to assure positive engagement of the sides of the frame with the wheels notwithstanding the attitude of the skateboard relative to the surface over which it moves.

Preferably, the frame is mounted on the rear end of the skateboard and in one form of the invention, a ball and socket joint couples the frame to the lower surface of the skateboard near its rear end. In another embodiment, the frame has structure defining a pair of slots on opposed sides thereof, and the ends of a mounting shaft, carried by the rear wheel assembly, is shiftably received within respective slots. This allows the frame to rotate about a verticle axis relative to the skateboard to prevent structural damage either to the frame or to the mounting shaft.

A cap coupled to the upper end of the stub shaft is in a position to be engaged by the user's foot to depress the shaft and thereby pivot the frame downwardly and into engagement with one or both of the adjacent wheels. A spring biases the cap and thereby the frame in an upward direction. The braking forces exerted on the wheels by the sides of the frame are applied in a logrithmic fashion so that the deceleration of the wheels requires a finite time, thereby assuring the control of the skateboard can be achieved even though the rotation of the wheels is not brought to a complete halt. There is a rotational effect afforded by a ball and socket joint to insure an infinate degree of freedom in adjusting the movement of the wheels and the applied braking forces. The ball and socket joint also allows movement of the frame in vertical and horizontal planes.

IN THE DRAWINGS

Figure 2:
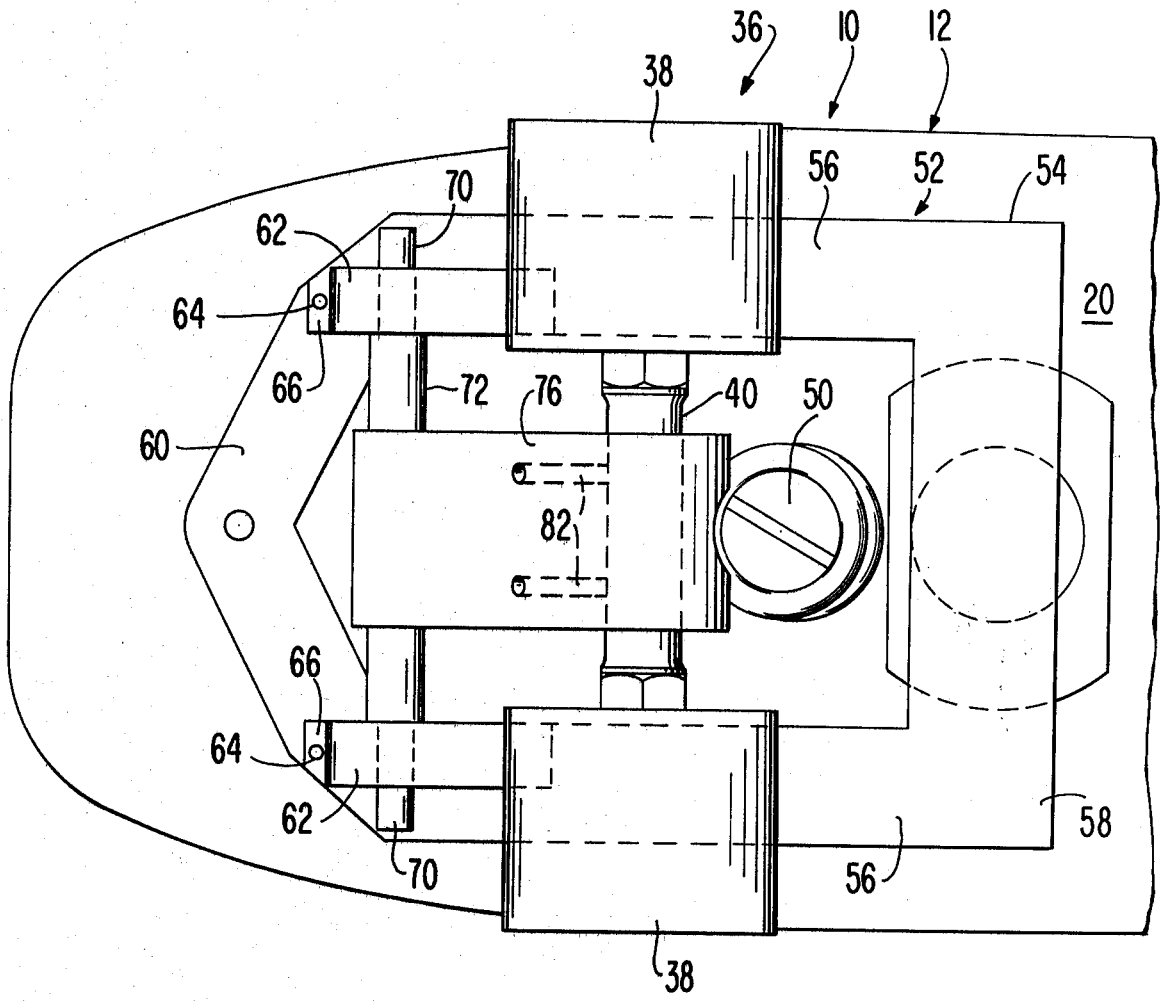
FIG. 2 is an enlarged, fragmentary bottom plan view of the skateboard, showing the control unit of FIG. 1.

The skateboard of the present invention is broadly denoted by the numeral 10 and includes a generally rigid board 12 having an upper surface 14 on which the feet of the user are placed in the usual manner. The board has a width as shown in FIG. 2 and is provided with a curved rear end portion 16 for aesthetic purposes.

Figure 1:
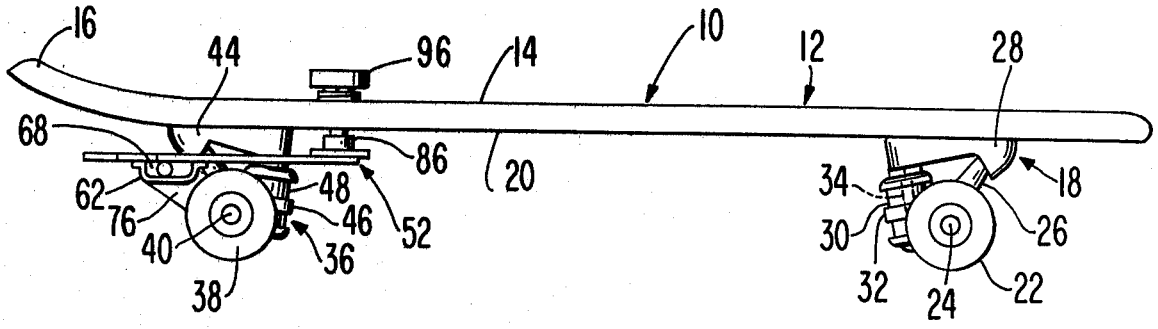
FIG. 1 is a side elevational view of the skateboard with a first embodiment of the control unit of the present invention coupled to the rear wheel assembly thereof.

A front wheel assembly 18 is provided on the lower surface 20 of board 12 at the front end portion thereof. Assembly 18 is conventional in construction and includes a pair of wheels 22 (only one of which is shown in FIG. 1) mounted for rotation on a generally horizontal shaft 24 carried by a brace 26 pivotally coupled by a ball joint or resilient mounting to the front end of a bracket 28, the latter being secured by screws or the like to lower surface 20 of board 12. The shaft is also carried by a resilient, tubular mounting device 30 coupled by a ring-like member 32 to brace 26. Brace 26 and member 32 are preferably integral with each other and are formed from a casting. Device 30 is made of a suitable resilient plastic or the like and is secured by a bolt 34 to the rear end of bracket 28. Thus, the mounting for shaft 24 allows it to pivot about horizontal and vertical axes to permit different degrees of cornering by wheel assembly 18 when skateboard 10 is used.

Board 12 has a rear wheel assembly 36 which is substantially of the same conventional construction as front wheel 18 in that it is a pair of wheels, a brace, a resilient device and a bracket for attachment to the board. To this end, assembly 36 has a pair of rear wheels 38 mounted on a generally horizontal shaft 40 for rotation. An inclined brace 42 is pivotally mounted at its upper, rear end, such as by a ball joint or resilient attaching device 45, to the rear end of a bracket 44 secured in any suitable manner, such as by screws, to board 12 at lower surface 20 thereof. Brace 42 has a ring-like member 46 surrounding a resilient, tubular mounting device 48 which surrounds a bolt 49 having a head 50 and threaded into the front end of bracket 44. Thus, shaft 40 can pivot about both horizontal and vertical axes to allow different degrees of cornering by rear wheel assembly 36 so as to cooperate with front wheel assembly 18.

Figure 3:
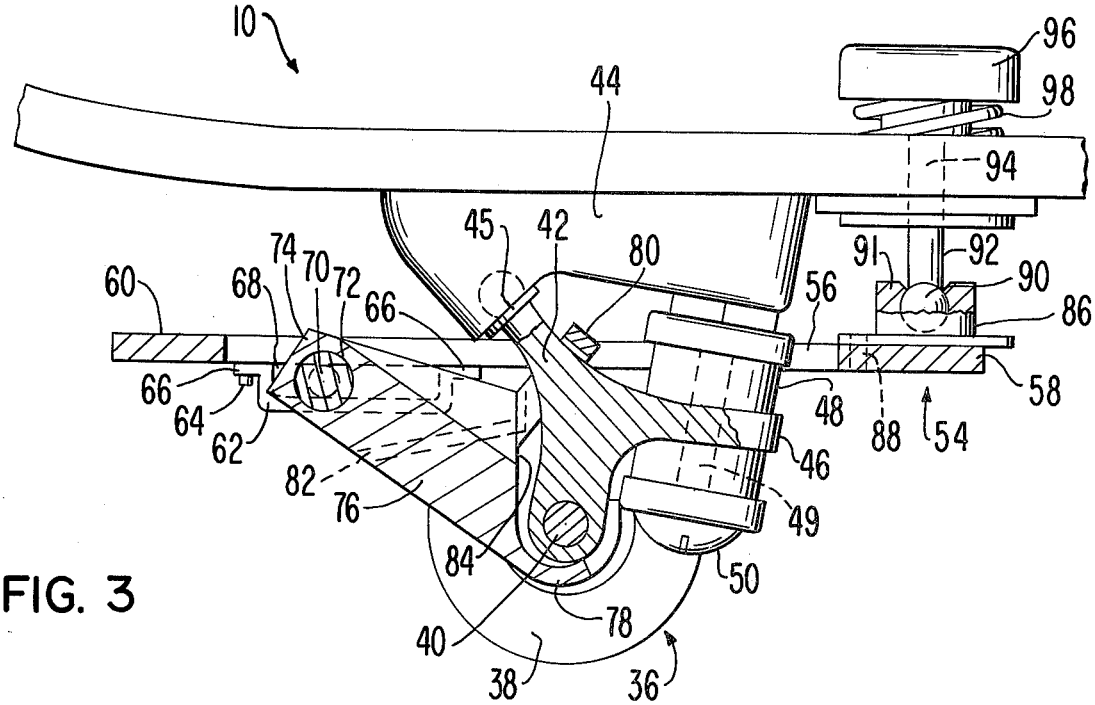
FIG. 3 is an enlarged, fragmentary, side elevational view, partly in section, showing the control unit of FIGS. 1 and 2.

One embodiment of the control unit for the skateboard is denoted by the numeral 52 and includes a frame 54 having a pair of spaced, generally parallel sides 56 having flat lower surfaces, a front portion 58, and a rear portion 60. Preferably, sides 56 and portions 58 and 60 are integral with each other and are coplanar as shown in FIGS. 1 and 3.

Each of sides 56 has a generally U-shaped member 62 secured by pins 64 to the corresponding side at the lower surface thereof near its rear end as shown in FIG. 2. Each member 62 has a pair of lateral flanges 66 for this purpose. Thus, each member 62 forms a slot 68 with the corresponding side 56 for shiftably receiving a respective, reduced end 70 of a shaft 72 ridgidly secured to the rear end 74 of a bracket 76 having a hook-like front end 78 (FIG. 3) partially surrounding shaft 40. A curved attachment member 80 partially surrounds brace 42 as shown in FIG. 3 and is secured by screws 82 (FIGS. 2 and 3) to a flat, inner face 84 (FIG. 3) of bracket 76. Thus, bracket 76 is secured to brace 42 yet shaft 40 can pivot about the aforesaid horizontal and vertical axes because ends 70 of shaft 72 are free to move in slots 68, thereby preventing any binding between rear wheel assembly 36 and frame 54.

Front portion 58 is provided with a ball joint 86 secured thereto in any suitable manner, such as by pins 88. Ball joint 86 includes a ball 90 rotatable within a socket member 91 and the ball has a stub shaft 92 extending upwardly therefrom and through a hole 94 in board 12, terminating in a cap 96 and surrounded by a coil spring 98 disposed between upper surface 14 and cap 96, the spring biasing the cap and the stub shaft upwardly. The purpose of the cap is to provide a control member, which, when depressed, causes frame 54 to move downwardly about an axis through shaft 72 so that the lower surface of sides 56 of the frame will move into engagement with wheels 38 and apply braking forces thereto. Ball joint 86 permits rocking of frame 54 about horizontal and vertical axes, such as when the skateboard is cornering and shaft 40 is also able to pivot about the corresponding horizontal or vertical axis as frame 54 is rocked. Hence, frame 54 is essentially coupled to shaft 40 due to the shiftable movement of ends 70 of shaft 72 in slots 68.

Ball 90 is rotatable in socket 91 and shaft ends 70 are moveable in slots 68 to insure that sides 56 are always substantially parallel to wheels 38 in all forms of maneuvers to thereby provide for uniform braking at all times and the same enjoyment from any position of riding. Thus many different maneuvers can be performed with the skateboard, yet the skateboard can be properly controlled at all times notwithstanding the capability of the control member to cause a braking action of the wheels to thereby enhance the enjoyment of the user of the skateboard. Moreover, it is possible that only one side 56 of frame 54 will be moved into engagement with a corresponding rear wheel 38, such as during a turn, so as to provide greater control of the movement of the skateboard.

In use, the skateboard is operated in the normal fashion and, when the skateboard is up to speed, the user can make turns or maneuvers by shifting his weight in certain directions to achieve desired results. During movement of skateboard, the user can depress cap 96 with the heel of the foot, causing frame 54 to pivot about the axis of shaft 72 to thereby cause sides 56 to move into braking relationship to rear wheels 38. When this occurs, the braking action will be a logarithmic function of time, tending to decelerate the skateboard. This deceleration can be controlled by the selective displacement of shaft 92 attached to cap 96, for it is possible that the user will not wish to come to a complete stop but merely to slow down during a specific maneuver or to execute a specific maneuver. The rate of speed decay is a direct function of the pressure applied to cap 96.

Ball joint 86 is extremely important to achieve the aforesaid control because it allows the skateboard to execute many different maneuvers without loss of control afforded by the engagement of frame 54 with rear wheels 38. Also, mounting the ends of shaft 72 on frame 54 by means of U-shaped members 62 assures that there will be adequate relative movement of rear wheel assembly 36 without causing structural damage thereto or to the control frame 54.

Figure 4:
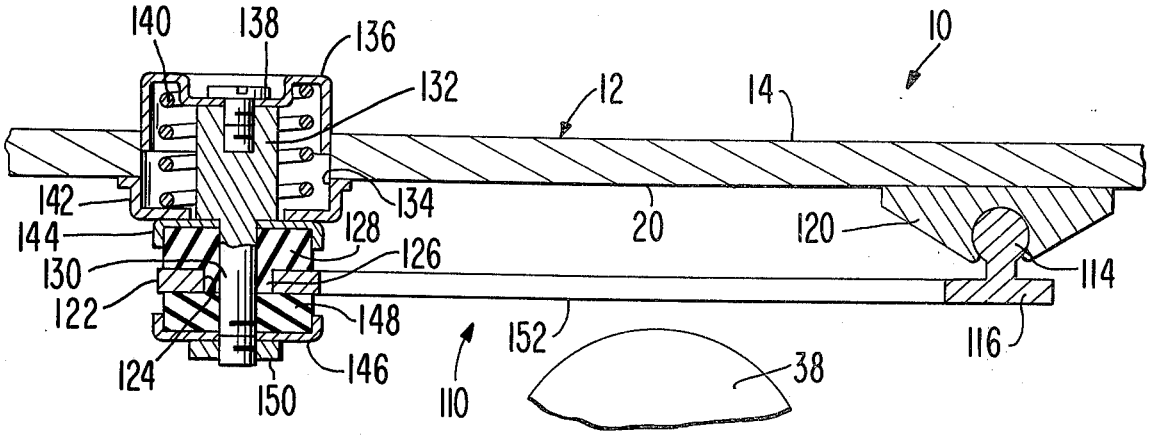
FIG. 4 is a view similar to that of FIG. 3, but showing another embodiment of the control unit.

Another embodiment of the control unit of the present invention is shown in FIG. 4 and is adapted for use with board 12 having rear wheels 38 as described above. To this end, the control unit, broadly denoted by the numeral 110, has a frame 112 of the same shape as frame 54 shown in FIG. 2. Frame 112 has a ball 114 attached to its rear portion 116, the ball being mounted in the socket of a socket member 120 attached to the lower surface 20 in any suitable manner.

Front portion 122 of frame 112 has a hole 124 therethrough for admitting a reduced portion 126 of a resilient member 128 surrounding a stub shaft 130 having an enlarged head 132 extending through an opening 134 formed through board 12. A cap 136 is secured by a screw to the upper end of head 132, and a coil spring 140 surrounding head 132 biases cap 136 upwardly, the lower end of the spring engaging a cup-shaped member 142 secured in any suitable manner, such as by screws or the like, to lower surface 20 of board 12. A pair of spaced, cup-shaped washers 144 and 146 confine resilient member 128 therebetween, member 128 having a lower portion 148 also surrounding shaft 130. A nut 150 is threaded on the lower end of shaft 130 to secure the same to member 128.

In use, the skateboard can perform maneuvers, such as turning as described above with respect to the skateboard having control unit 52 thereon. When it is desired to apply a braking force to either or both of rear wheels 38, the user depresses cap 136, causing head 132 to depress resilient member 128 to cause downward meovement of frame 112 so that the flat, lower surface 152 of one or both sides of the frame moves into braking engagement with one or both rear wheels 38. The resilient nature of member 128 permits frame 112 to pivot about both horizontal and vertical axes and serves the same purpose as the ball joint 86 of the first embodiment. Frame 112 can also rock at its rear end due to the ball joint arrangement afforded by ball 114 in socket 118. Thus, the user can perform a wide variety of maneuvers with a minimum of effort because of the control provided frome 112. Again, the braking action will be a logarithmic function with time, rather than an abrupt stopping of the skateboard. In this way, better control can be provided because the deceleration may not be great enough to cause a complete stopping of the skateboard, thereby permitting wider latitude in the operation of the skateboard. The rate of decay of the skateboard speed will vary directly with the pressure applied by depressing cap 136.

Either of the two embodiments of the control unit can be releasably mounted on an existing skateboard; thus, the control unit can be packaged and sold as a kit separate from the skateboard itself. This is possible because the control unit is releasably coupled either to the rear wheel and axle assembly (the embodiment of FIGS. 1–3) or releasable coupled to the lower surface of the board (embodiment of FIG. 4). In either case, a hole will need to be drilled in the board to receive the actuator (stub shaft 92 of FIGS. 1–3 and stub shaft 130 of FIG. 4.) The control unit can easily be secured in place on an existing skateboard with a minimum of effort.

We claim:

1. A skateboard comprising: a board having an upper surface, a lower surface, and a pair of spaced wheel and axle assemblies mounted on said lower surface to permit the board to move over a support surface, one of the assemblies having a pair of wheels; an elongated frame having a pair of opposed sides; means pivotably mounting the frame adjacent to one end thereof for pivotally mounting the frame on said one assembly to permit said sides of the frame to move into and out of engagement with respective wheels of said one assembly for applying a braking force thereto as said board moves over said support surface; a shiftable actuator accessible to the foot on the upper surface of the board; means coupling the actuator to said frame near the opposite end thereof, said coupling means permitting the frame to pivot about a pair of relatively angularly disposed axes, said actuator being shiftable for moving said frame in one direction and said sides into engagement with said wheels; and means for biasing the frame in the opposite direction.

2. A skateboard as set forth in claim 1, wherein said coupling means includes a ball and socket joint.

3. A skateboard as set forth in claim 1, wherein said coupling means includes a reciprocal stub shaft, and wherein said biasing means comprises resilient means surrounding the stub shaft for coupling the same to said frame.

4. A skateboard as set forth in claim 3, wherein said acutator has a cap at the upper end thereof, said bias means including a spring between the cap and said board.

5. In a skateboard having a board provided with an upper surface, a lower surface, and a pair of wheel and axle assemblies mounted on the lower surface thereof with one of the assemblies having a pair of wheels, a control unit comprising an elongated frame having a pair of opposed sides; means pivotably mounting said frame adjacent to one end thereof for pivotally mounting the frame on said one assembly to permit the sides of the frame to move into and out of engagement with respective wheels of said one assembly for applying braking forces to said wheel; an actuator adapted to be carried on said board at a location accessible to the upper surface thereof; means coupling the actuator to said frame near the opposite end thereof, said coupling means permitting the frame to pivot about a pair of relatively angularly disposed axes, said actuator being shiftable for moving said frame in one direction and into engagement with said wheel when said frame is coupled to said one assembly; and means coupled with said frame for biasing the same in the opposite direction when said frame is coupled to said one assembly.

6. A skateboard as set forth in claim 5, wherein said coupling means includes a ball and socket joint.

7. A skateboard as set forth in claim 5, wherein said coupling means includes a reciprocal stub shaft, and wherein said biasing means comprises resilient means surrounding the stub shaft for coupling the same to said frame.

8. A skateboard as set forth in claim 5, wherein said actuator has a cap at the upper end thereof, said bias means including a spring between the cap and said board.

9. A skateboard comprising: a board having an upper surface, a lower surface, and a pair of spaced wheel and axle assemblies mounted on said lower surface to permit the board to move over a support surface, one of said assemblies having a pair of wheels, a frame having a pair of opposed sides in vertical alignment with respective wheels of said one assembly; means on said frame for defining a pair of opposed slots thereon with the slots extending fore and aft relative to the longitudinal axis of the board; a transversely extending mounting shaft; means coupling the mounting shaft to said one assembly, said mounting shaft having a pair of opposed ends shiftably and pivotably received within respective slots to permit said sides of the frame to move into and out of engagement with the wheels of said one assembly for applying a braking force thereto as said board moves over said support surface; an actuator accessible to the foot on the upper surface of the board and connected to said frame for moving said frame in one direction and into engagement with said wheel; and means coupled with said frame for biasing the same in the opposite direction.

10. A skateboard as set forth in claim 9, wherein said means coupling the mounting shaft includes means releasably attaching said mounting shaft on said one wheel and axle assembly.

11. In a skateboard having a board provided with an upper surface, a lower surface, and a pair of wheel and axle assemblies mounted on the lower surface thereof, with one of the assemblies having a pair of wheels, a control unit comprising: a frame having a pair of opposed sides and means on the frame for defining a pair of opposed slots; a transversely extending mounting shaft; means coupled to said mounting shaft for connecting the same to said one assembly, said mounting shaft having a pair of opposed ends shiftably and pivotably received within respective slots, the latter extending fore and aft relative to the board when said mounting shaft is connected to said one assembly to permit the sides of the frame to move into and out of engagement with the wheels of said one assembly for applying braking forces on said wheel; an actuator adapted to be carried on said board and connected to said frame at a location accessible to the upper surface thereof for moving said frame in one direction and said sides into engagement with said wheels; and means for biasing the frame in the opposite direction when said mounting shaft is coupled to said one assembly.

12. A skateboard as set forth in claim 4, wherein said means coupled to said mounting shaft includes means releasably attaching said mounting shaft on said one wheel and axle assembly.

13. A skateboard comprising: a board having an upper surface, a lower surface, and a pair of spaced wheel and axle assemblies, there being a hole through the board at a location adjacent to and forwardly of the rear wheel and axle assembly, each assembly having a pair of wheels; a frame having a pair of spaced opposed sides above and in vertical alignment with respective wheels of said rear wheel and axle assembly; means pivotally mounting said frame on said rear wheel and axle assembly to permit said sides to move into and out of engagement with respective wheels to apply braking forces thereto; a stub shaft extending through said hole and projecting above said upper surface of the board; means biasing said stub shaft upwardly; and a ball and socket joint pivotally coupling the lower end of the stub shaft with said frame to cause the latter to pivot downwardly to urge said sides into engagement with respective wheels when the stub shaft is depressed by the foot disposed on said upper surface of the board.

* * * * *